US007890152B2

(12) United States Patent
Edgar et al.

(10) Patent No.: US 7,890,152 B2
(45) **Date of Patent: *Feb. 15, 2011**

(54) HANDHELD APPARATUS AND METHOD FOR THE AUTOMATED APPLICATION OF COSMETICS AND OTHER SUBSTANCES

(75) Inventors: Albert D. Edgar, Austin, TX (US); David C. Iglehart, Austin, TX (US); Rick B Yeager, Austin, TX (US)

(73) Assignee: TCMS Transparent Beauty LLC, Austin, TX (US)

( * ) Notice: Subject to any disclaimer, the term of this patent is extended or adjusted under 35 U.S.C. 154(b) by 155 days.

This patent is subject to a terminal disclaimer.

(21) Appl. No.: 12/028,835

(22) Filed: Feb. 11, 2008

(65) Prior Publication Data

US 2008/0193195 A1 Aug. 14, 2008

Related U.S. Application Data

(60) Provisional application No. 60/889,291, filed on Feb. 11, 2007, provisional application No. 60/889,299, filed on Feb. 12, 2007, provisional application No. 60/889,288, filed on Feb. 11, 2007.

(51) Int. Cl.
*A61B 5/00* (2006.01)

(52) U.S. Cl. ..... 600/310; 347/1

(58) Field of Classification Search ..... 382/128; 348/77; 347/2, 108, 109; 358/473; 400/88; 600/407, 473–479

See application file for complete search history.

(56) References Cited

U.S. PATENT DOCUMENTS

| | | | | |
|---|---|---|---|---|
| 6,312,124 | B1 * | 11/2001 | Desormeaux | 347/109 |
| 6,341,831 | B1 * | 1/2002 | Weber et al. | 347/1 |
| 6,487,440 | B2 * | 11/2002 | Deckert et al. | 600/476 |
| 6,719,467 | B2 * | 4/2004 | Hess et al. | 400/76 |
| 7,382,400 | B2 * | 6/2008 | Sablak | 348/208.99 |
| 2007/0016078 | A1 * | 1/2007 | Hoyt et al. | 600/476 |
| 2007/0035815 | A1 | 2/2007 | Edgar et al. | |
| 2007/0049832 | A1 | 3/2007 | Edgar et al. | |
| 2008/0192999 | A1 | 8/2008 | Edgar et al. | |
| 2008/0194971 | A1 | 8/2008 | Edgar et al. | |
| 2008/0219528 | A1 | 9/2008 | Edgar et al. | |

* cited by examiner

*Primary Examiner*—Brian Casler
*Assistant Examiner*—Elmer Chao
(74) *Attorney, Agent, or Firm*—Fish & Richardson P.C.

(57) ABSTRACT

An applicator head is provided for a reflectance modifying agent (RMA) applicator is moved across the skin by means of a floating ring having dispersed raised contact points to maintain a proper distance from the surface to be treated, reduce the influence of outside light during scanning, and limit smudging during deposition. During an application session, software on the computer uses a camera to sense aspects of color and texture on human features, calculates cosmetic enhancements, and uses the printer head to apply RMA precisely to the features to create those enhancements. Skin landmarks are used for registration. The head uses differential lighting by providing a sequence of directional lighting, with some exposures left dark to adjust for ambient light leakage. The exposures are co-synchronized in stacks, where each stack is a grouping of data about a particular instant of time during the scanning.

15 Claims, 12 Drawing Sheets

HANDHELD APPARATUS AND METHOD FOR THE AUTOMATED APPLICATION OF COSMETICS AND OTHER SUBSTANCES

CROSS-REFERENCE TO RELATED APPLICATIONS

This patent application is related to U.S. Provisional Patent Application No. 60/889,291 filed Feb. 11, 2007 by the present inventors for "HANDHELD APPARATUS AND METHOD FOR THE AUTOMATED APPLICATION OF COSMETICS AND OTHER SUBSTANCES" and claims the filing date of that Provisional application; and is related to U.S. Provisional Patent Application No. 60/889,299 filed Feb. 12, 2007 by the present inventors for "SYSTEM AND METHOD FOR APPLYING A REFLECTANCE MODIFYING AGENT TO IMPROVE THE VISUAL ATTRACTIVENESS OF HUMAN SKIN WITH MOTION MEANS WITH DISPERSED CONTACT POINTS"; and is related to U.S. Provisional Patent Application No. 60/889,288 for "DIFFERENTIAL LIGHTING FOR IDENTIFYING SURFACE TEXTURE" filed Feb. 11, 2007 by the present inventors.

This patent application incorporates by reference the specification, drawings, and claims of U.S. patent application Ser. No. 11/503,806 filed Aug. 14, 2006 by the present inventors for "SYSTEM AND METHOD FOR APPLYING A REFLECTANCE MODIFYING AGENT TO IMPROVE THE VISUAL ATTRACTIVENESS OF HUMAN SKIN".

FIELD OF THE INVENTION

The current invention relates to automated computer-controlled methods to identify skin texture and to selectively and precisely apply one or more reflectance modifying agent, such as a dye or pigment, to human skin to improve its visual attractiveness.

BACKGROUND OF THE INVENTION

Prior Cosmetic Techniques and Their Disadvantages

Prior art techniques for modifying the appearance of skin include natural tanning, artificial tanning, and the deliberate application of cosmetics. Each of these prior art techniques has limitations.

Typically, the applications of cosmetic substances to skin are largely manual, for example through the use of brushes, application tubes, pencils, pads, and fingers. The application methods make prior art cosmetics imprecise, labor intensive, expensive, and sometimes harmful, when compared to the computerized techniques of the present invention.

Most prior art cosmetic approaches are based on the application of opaque substances. As explained in the cross-referenced application U.S. Ser. No. 11/503,806, there is a need for the precise computer-controlled application of reflectance modifying agents (RMAs), such as transparent dyes, to provide a more effective modification of appearance.

In this specification, the terms "reflectance modifying agent" or "RMA" refer to any compound useful for altering the reflectance of another material, and are explained in further detail below. Some examples of RMA are inks, dyes, pigments, bleaching agents, chemically altering agents, and other substances that can alter the reflectance of human skin and other features. The terms "dye" and "transparent dyes" are used for brevity in this specification to represent any RMA.

Manual cosmetic applications are imprecise compared to computer-controlled techniques, and this imprecision may make them less effective. For example, the heavy application of a foundation base for makeup may cause an unattractive, caked-on appearance. Manual techniques also typically take a long time to employ, as can be seen in any morning commute on a highway, where people frantically take advantage of stops to finish applying their makeup. In addition, manually applied makeup is not cheap, and when the help of professionals such as beauticians is required, is even more expensive. Moreover, often the materials applied to the skin in manual techniques are themselves potentially harmful. For example, a foundation base for makeup may cause skin to dry out and may inhibit the skin's breathing. Sunlight or artificial light used for tanning may cause cancer.

Therefore, there is a need for the precise application of reflectance modifying agents (RMAs) to provide a more effective, more automated, faster, less expensive, and less dangerous modification of the appearance of skin. The cross-referenced patent application cited above presents a system and method for this need.

One problem that an automated system and method of applying RMAs must solve is the design of an applicator with an efficient head. In an embodiment, a useful applicator would be small enough to be held in the hand, would be easy to clean, and would be inexpensive to produce. In addition, it would maintain the scanner and RMA application system at an appropriate distance from the surface to be treated, to ensure accurate scanning and deposition. If the scanner is located too far from or too close to the surface, for example, the results of scanning may not be not be accurate enough to provide a basis for pixel-level cosmetic enhancements. In the same way, a printer head that is not maintained at a proper distance from the surface, for example, will not be able to apply the RMAs with pixel-level precision.

An additional challenge in designing an automated RMA system is preventing outside light from entering around the base of the applicator and scanner and distorting the accuracy of the scanning.

Moreover, the design of the applicator must limit smudging of the RMAs on the surface treated, which may result from contact with hardware elements of the scanner or inkjet printer head. If the rim of an inkjet printer head used for applying RMAs drags across the skin during deposition, for example, it may smudge the effect of the RMAs on the skin. This is especially a problem when applications involve making multiple passes over the surface, because the freshly deposited RMAs may be easily smudged by too much contact with hard surfaces. Therefore, there is also a need for an RMA applicator head designed so that the applicator is small enough to be handheld, easy to clean, and inexpensive, and that maintains a proper distance between the scanner and RMA printer head and the surface to be treated, while reducing the influence of outside light during scanning and limiting smudging during deposition.

An important element of a cosmetic enhancement system is the ability to separate a scanned image of an area of skin or other human feature into two components, color and surface texture. Color refers to an area's light value, such as lightness and darkness, as well as hue, such as pinkness or yellowness. Surface texture refers to the area's topography, such as the contours of pores, wrinkles, and bumps, both large and small.

For example, the system's software uses strategies to accentuate, alter, or camouflage color effects and different strategies for surface texture effects, to make a woman look both young and real.

BRIEF SUMMARY OF THE INVENTION

These and other needs are addressed by the present invention. The following explanation describes the present invention by way of example and not by way of limitation.

It is aspect of the present invention to provide an RMA applicator head that is small enough for a handheld applicator.

It is another aspect of the present invention to provide an RMA applicator head that is easy to clean.

It is still another aspect of the present invention to provide an RMA applicator head that is inexpensive.

It is another aspect of the present invention to provide an RMA applicator head that maintains a proper distance between its scanner and printer head and the surface to treated, while reducing the influence of outside light during scanning and limiting smudging during deposition.

In accordance with the present invention, a computer-controlled system determines attributes of a frexel, an area of human skin, and applies a reflectance modifying agent (RMA) at the pixel level, to make the skin appear more attractive. The system's scanner and RMA applicator are moved across the skin by means of elements with dispersed raised contact points, for example pounce wheels, which are wheels with points around their outer rims. These contact points maintain a proper distance from the surface to be treated, reduce the influence of outside light during scanning, and limit smudging during deposition. Different motion means with dispersed raise contact points may also used, such as a ball, a comb-like walker, or other geometrical shapes. For example, a square configuration of motion means may be used or a circular one.

In one embodiment, the applicator head further comprises a thin inkjet printer head, a telecentric field lens, a camera, and an RMA reservoir and is attached via a power and data cable to a computer. During an application session, software on the computer uses a camera to sense aspects of color and texture on human features, calculates cosmetic enhancements, and uses the printer head to apply RMA precisely to the features to create those enhancements. Skin landmarks are used for registration.

It is aspect of the present invention to provide an effective method to determine surface texture from scanned data about an area of skin or other human feature.

This and other aspects, features, and advantages are achieved according to the system and method of the present invention. In accordance with the present invention, a software method of differential lighting automatically determines aspects of surface texture from scanned data about an area of skin or other human feature, using a computerized system for scanning that area, calculating enhancements, and applying cosmetics. Scanning with varying configurations of applied lighting captures images in a cycle, with the lighting for some exposures left dark. The exposures are co-synchronized in stacks, where each stack is a grouping of data about a particular instant of time during the scanning. This data may be obtained from directly captured exposures or from interpolated data. Data from an exposure made without applied lighting is subtracted from each stack to remove edge leakage from ambient light. The remaining exposures are used to generate the albedo (color), the north-south tilt, and the east-west tilt of the scanned area. The exposures are then stacked in their visual position in computer memory, and the data is updated using a noise filtering average.

BRIEF DESCRIPTION OF THE DRAWINGS

The following embodiment of the present invention is described by way of example only, with reference to the accompanying drawings, in which.

DETAILED DESCRIPTION

Applicator Head with Raised Contact Points

In this embodiment, the present invention comprises an applicator head for an applicator used with a computer-controlled system and method that scans an area of human skin, identifies unattractive attributes, and applies the RMA, typically with an inkjet printer, to improve the appearance of that area of skin. U.S. application Ser. No. 11/503,806 filed Aug. 14, 2006 by the present applicants describes a computer-controlled system and method.

Figure 1:
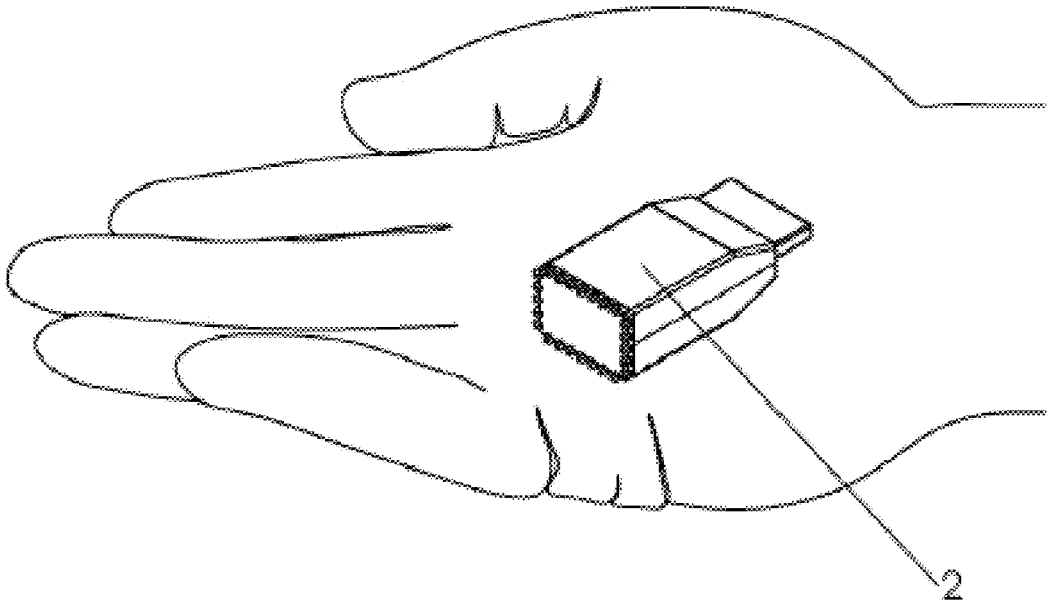
FIG. 1 is a block diagram that illustrates the relative size an RMA applicator head.

An example applicator head 2, shown in FIG. 1, covers an area of skin about equal to a single electric razor head. Such a size is proven daily to fit in intimate contact across a human face.

In an embodiment for speed of application, multiple applicator heads 2 may be assembled in a floating mount, just as multiple floating heads are combined in a single electric razor.

Applicator Head

Figure 2:
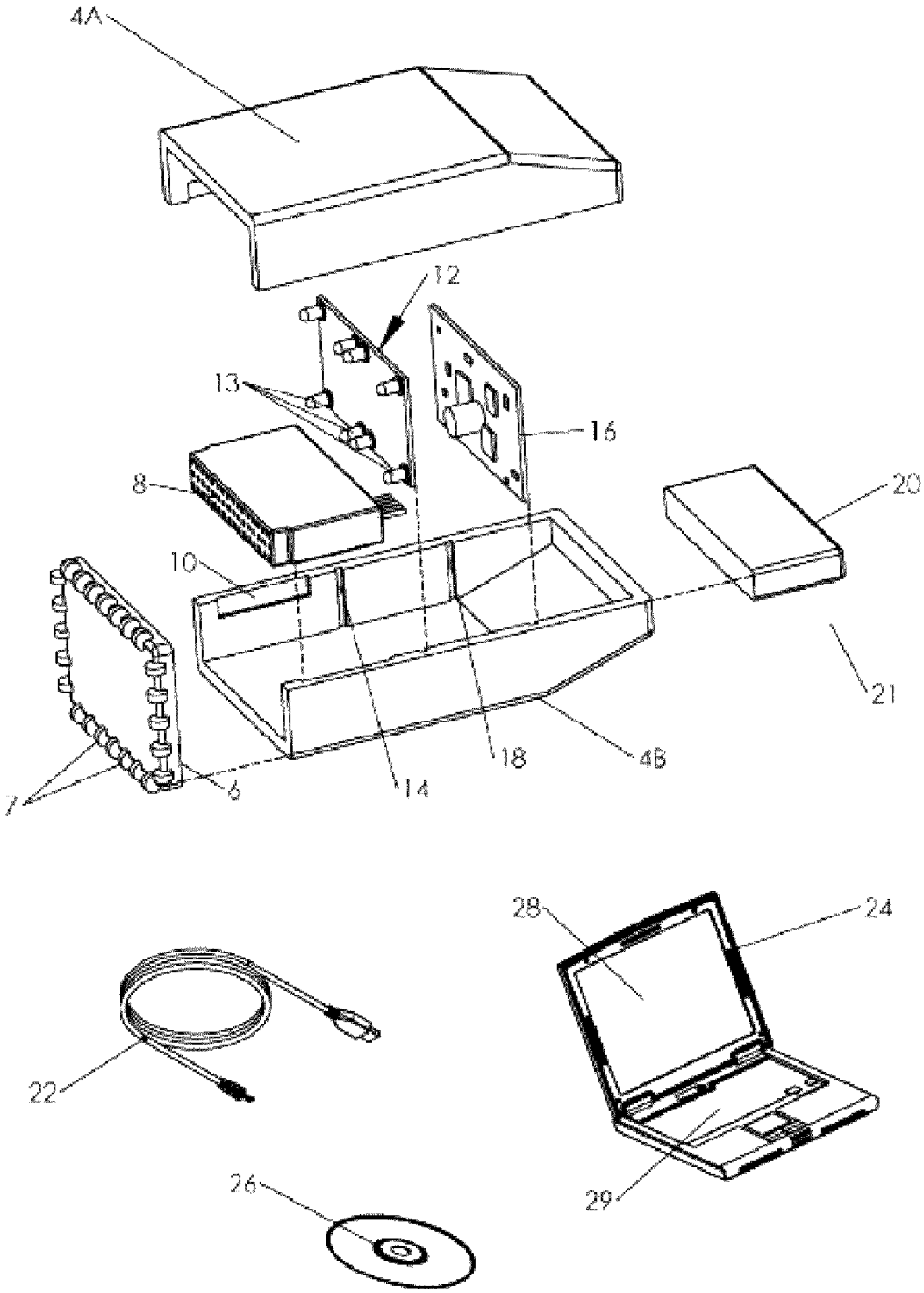
FIG. 2 is a block diagram that illustrates elements of an RMA applicator head.

In one embodiment, the applicator head 2 comprises the following elements, as illustrated in FIG. 2.

Plastic Case

The molded case 4A and 4B has rubber "O" type rings for waterproofing, so that the applicator head 2 can be run under the faucet for cleaning, like a razor. The inkjet printer head 8 can be maintained this way, which is not an option in normal printers. In an embodiment, the applicator head 2 may "park" for storage on a stand that would cap the applicator head 2.

Floating Ring

The applicator head 2 is moved across the skin by means of a floating ring 6 with elements with dispersed raised contact points. These contact points maintain a proper distance from the surface to be treated, reduce the influence of outside light during scanning, and limit smudging during deposition. One example of dispersed raised contact points are pounce wheels which are discussed below.

Inkjet Head

A very thin inkjet head 8, illustrated in FIG. 2, fits perpendicularly to the skin into case groove 10.

Field Lens

A field lens 12 assembly with LED assembly 13 provides telecentric viewing so that size is independent of distance and the view fits around the inkjet head. It fits into case groove 14 and helps protect the electronics behind the lens from water and dirt.

Camera

A camera module 16 with electronics fits into case groove 18.

In an embodiment, the camera module 16 may be a module made for mobile devices such as cell phones. The newer of these modules have 3 megapixels and above. In covering an area half an inch across, just a 1 megapixel camera would have 4 times the resolution of the human eye at 10 inches.

Cosmetic Reservoir

A replaceable cosmetics reservoir 20 and ink is shown only as a block, but it should have a visually appealing and protectable design because it is what consumers would actually buy repeatedly, like razor blades. In an embodiment, the cosmetics reservoir 20 may contain multiple separate RMA colors that may be mixed to achieve desired effects. In another embodiment, it may contain a single RMA color premixed to achieve a desired aim color or effect.

Cable and Computer

In one embodiment, the applicator head 2 is attached to a computer with a cable. In this example, a data and power cable 22 is required. In an embodiment, a USB 2.0 cable may be used. In this example, a consumer computer 24 is required. Almost any newer computer configured correctly with enough disk memory, good display, and a USB port may be used.

Software

Software 26 is required that runs on the computer 24 and provides the functionality for scanning an area of a human feature, such as skin, calculating cosmetic enhancements, tracking registration, and applying the RMA, explained in detail in the cross-referenced application and outlined below.

Method of Operation

The applicator head 2 enables RMA applications that are like conventional cosmetic applications in the sense that the user actually chooses an aim color and "brushes" it on the desired area. This allows a user to select an "aim" skin color, and then deposit to that density. By optical feedback on each frexel (area of human skin), RMA, such as ink or dye, is deposited on each pass until that density is reached. Then no more dye is deposited on subsequent passes. The user may choose to change the aim color manually while applying to different parts of the skin, just as current art requires different colors of blush to be manually selected and applied to different parts of the face to achieve a shaded effect.

In this patent application, the phrase "area of skin" is used to represent any human feature to be enhanced.

Figure 3:
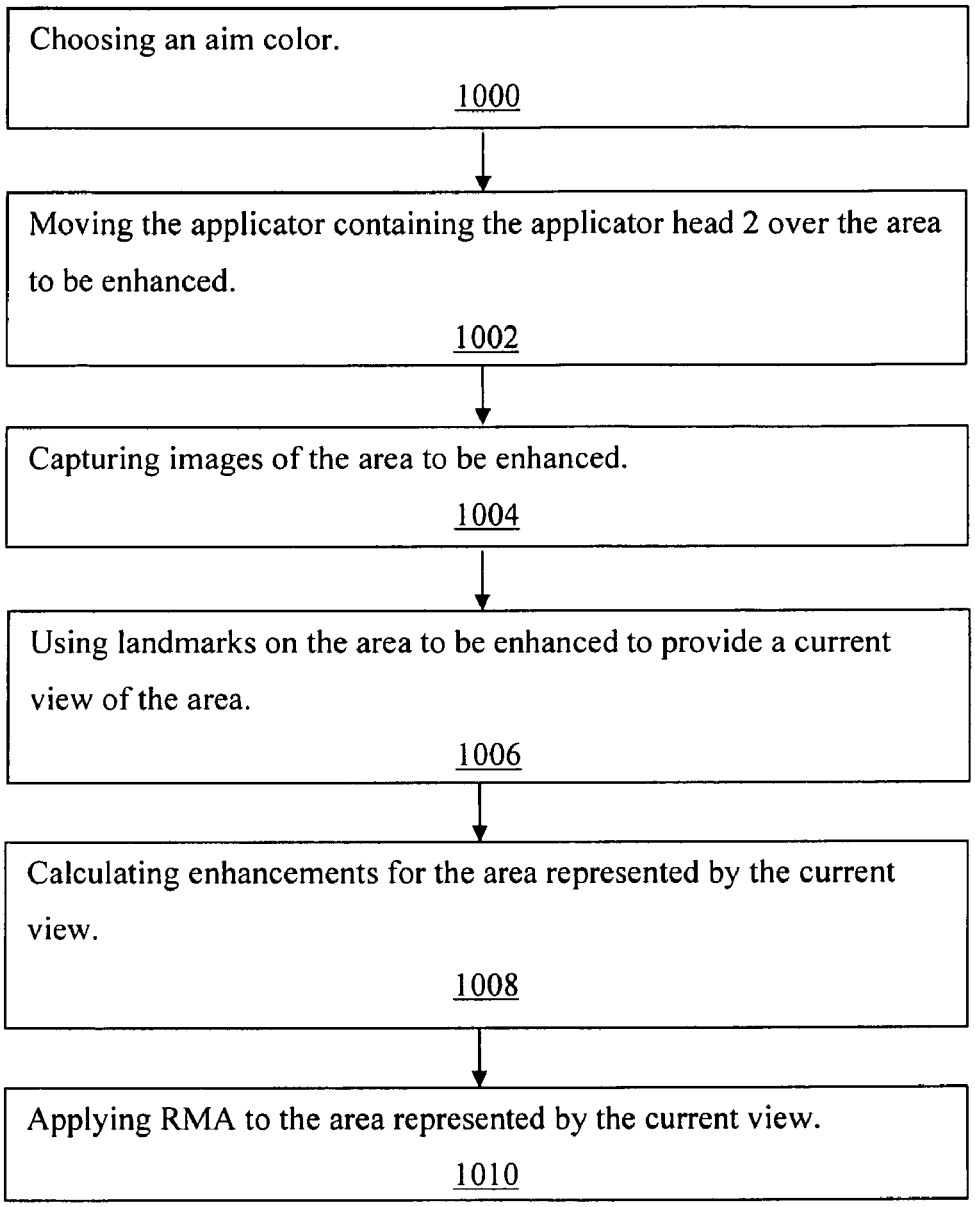
FIG. 3 is a flow chart illustrating the general steps for a process of applying RMA with the applicator head.

The general steps of this process are illustrated in FIG. 3.

Step 1000 in FIG. 3—Choosing an Aim Color.

In an embodiment, a user employs an interface on the computer 24, shown in FIG. 2, to select an "aim" skin color to be achieved through an appropriate mix of separate RMA colors contained in the cosmetic reservoir 20. In another embodiment, controls on the applicator may be used to select the aim color.

In yet another embodiment, an applicator may contain premixed RMA for a single aim color, and different applicators may contain different single aim colors. For example, one user might buy an applicator with a light RMA aim color, and another user might buy a different applicator with a darker aim color.

Step 1002 in FIG. 3—Moving the Applicator Containing the Applicator Head 2 Over the Area to be Enhanced.

Figure 4:
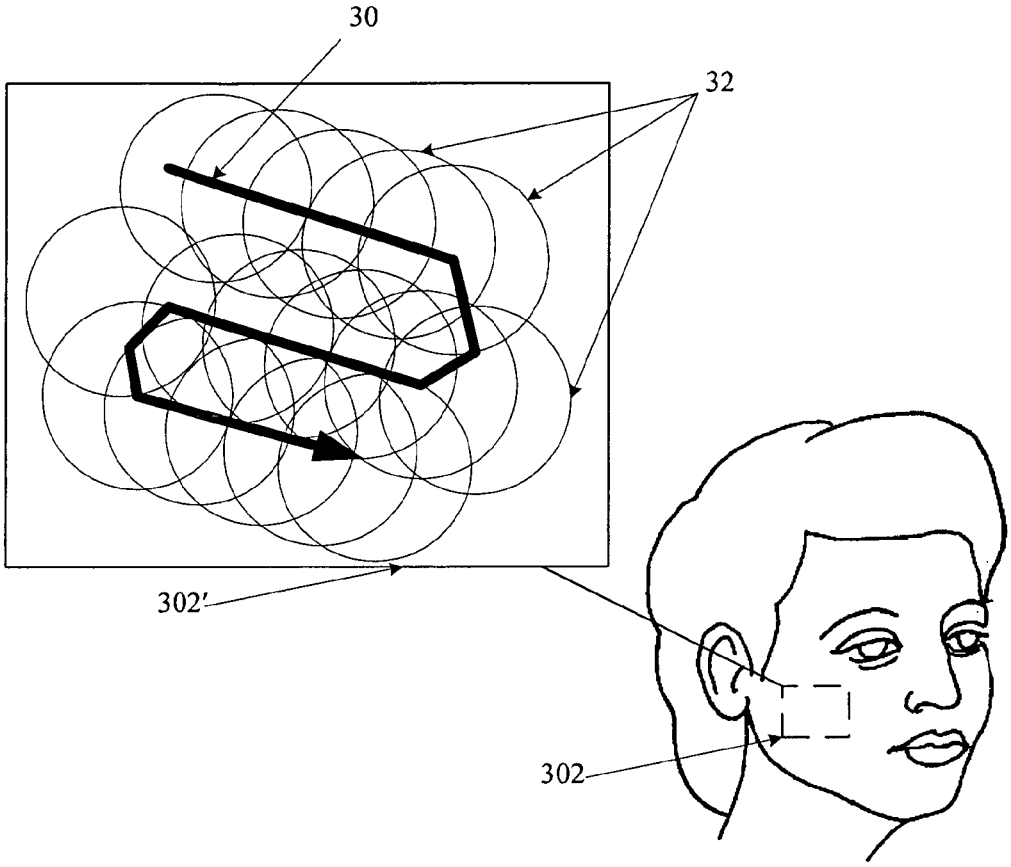
FIG. 4 is a representative diagram illustrating a path of movement of the applicator head over an area of skin whereby multiple overlapping images may be captured.

The user moves the applicator containing the applicator head 2, shown in FIG. 2, over an area of skin 302, shown in FIG. 4, to be enhanced. As the applicator head 2, shown in FIG. 2, is placed on the skin, data from the skin under the applicator is immediately seen as a "current" view.

Step 1004 in FIG. 3—Capturing Images of the Area to be Enhanced.

As the applicator is moved in a pattern of movement 30, for example the pattern 30 shown in FIG. 4, overlapping images 32 are captured by the camera module 16, shown in FIG. 2, at least 10 per second. Most of the image at each capture is redundant with the previous capture.

Step 1006 in FIG. 3—Using Landmarks on the Area to be Enhanced to Provide a Current View of the Area.

Using landmarks, or "skinmarks" on the area of skin 302, shown in FIG. 4, software 26, shown in FIG. 2, tracks relative movement of the applicator and combines images in computer memory to give an expanded current view of the skin, using only views from the current application session. For example, pores, moles, scars, lines, wrinkles, age spots, sun damage, freckles, color variations, contours of features, textural variations such as bumps, and many other aspects of human features may be used as landmarks.

An application session is defined to start when the applicator touches the skin and to end when it is retracted. When the applicator is retracted from the skin, in this mode, all knowledge is erased, and the next application session starts fresh by again placing the applicator some place on the skin and manually sweeping it around an area.

As the applicator is swept back and forth in a path of movement 30, shown in FIG. 4, in a single application session, this current view can cover a large area of skin 302 and develop momentary strategies for partial and overlapping deposition on each sweep. Whole-body makeup may be accomplished through multiple sweeps without retracting the applicator from the skin.

Positional Data

Figure 5:
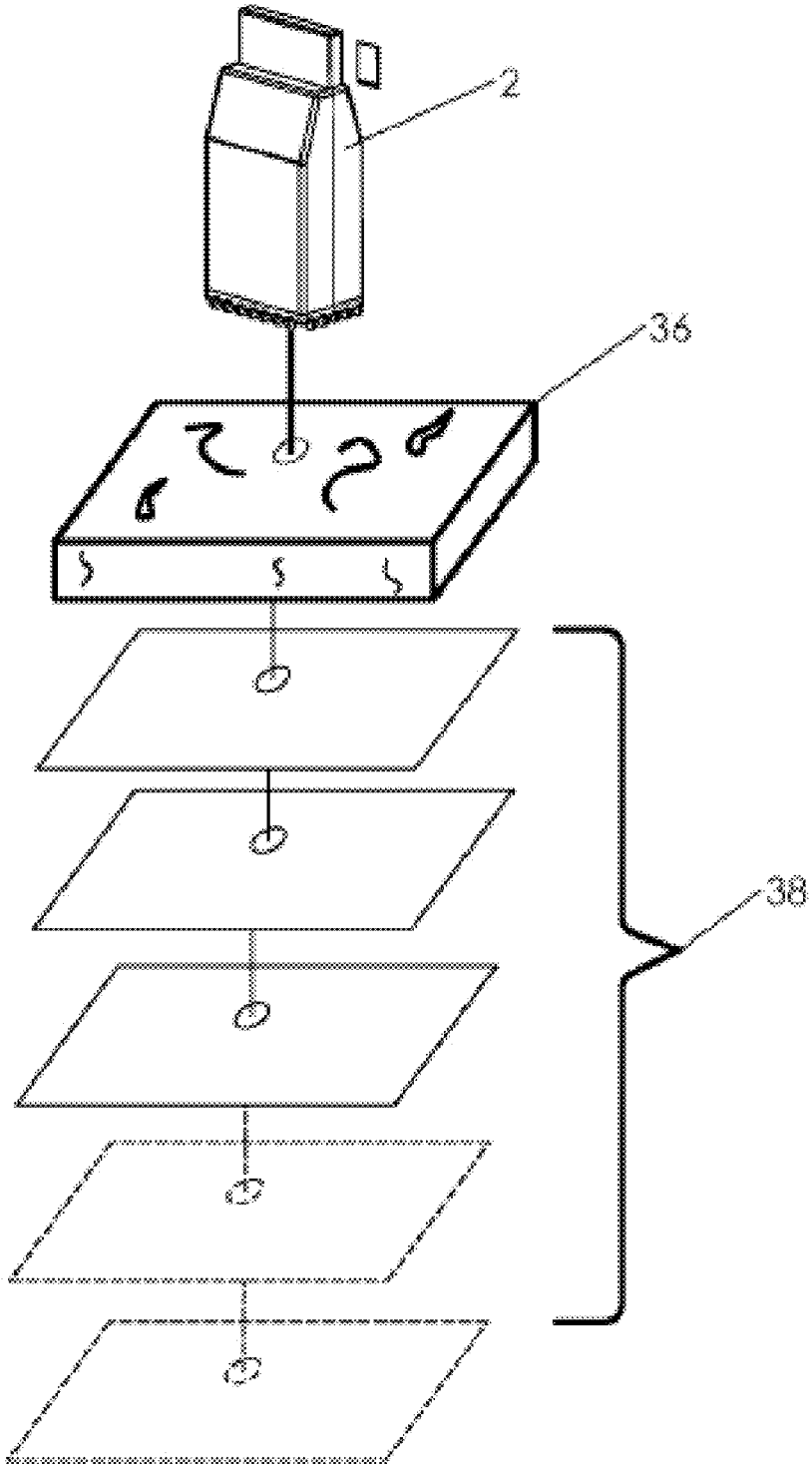
FIG. 5 is a representative diagram illustrating aspects associated with the present invention that require registration.

The software 26, shown in FIG. 2, must be able to determine that a skin defect is underneath the inkjet head 8 at the moment the inkjet head 8 needs to be fired, even though at that precise moment the inkjet head 8 is covering the skin defect from view. As shown in FIG. 5, this requires knowledge of applicator head 2 position relative to real skin 36, and a mapping from real skin 36 to abstract layers 38 in computer memory that model that skin, describe aesthetic choices, guide execution strategies, and track long term changes. The positional information provided by the skinmarks described above enables the software 26, shown in FIG. 2, to keep the applicator head 2, the area of skin 302, shown in FIG. 4, and computer models in register.

Step 1008 in FIG. 3—Calculating Enhancements for the Area Represented by the Current View.

The software 26, shown in FIG. 2, calculates cosmetic enhancements to the area of skin 302, shown in FIG. 4, using the methods described in the cross-referenced patent application.

Step 1010 in FIG. 3—Applying RMA to the Area Represented by the Current View.

RMA, such as ink or dye, contained in the cosmetic reservoir 20, shown in FIG. 2, is deposited by the inkjet head 8 onto the area of skin shown in the current view, for example the area of skin 302 shown in FIG. 4, to achieve desired cosmetic enhancement. The RMA is deposited on each pass of the applicator over the area of skin 302 until the chosen aim color is reached. Then no more dye is deposited on subsequent passes.

Application of Other Substances than RMAs

The applicator of the present invention may be used to apply other substances than RMAs, for example medically beneficial compounds or live skin.

DETAILED DESCRIPTION

Pounce Wheels and Other Motion Means with Dispersed

Contact Points

Figure 6A:
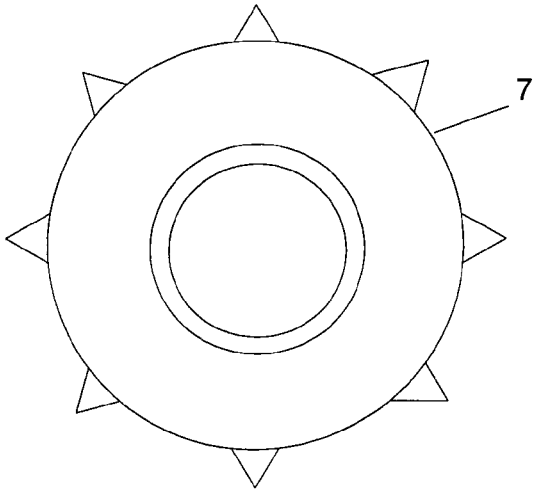
FIG. 6A is a representational diagram illustrating a side view of a pounce wheel.
Figure 6B:
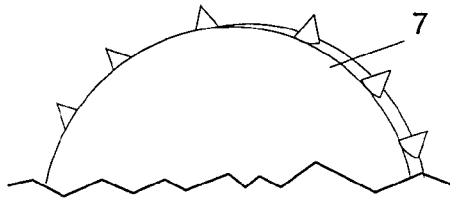
FIG. 6B is a representational diagram illustrating a view of a pounce wheel at an angle.
Figure 7:
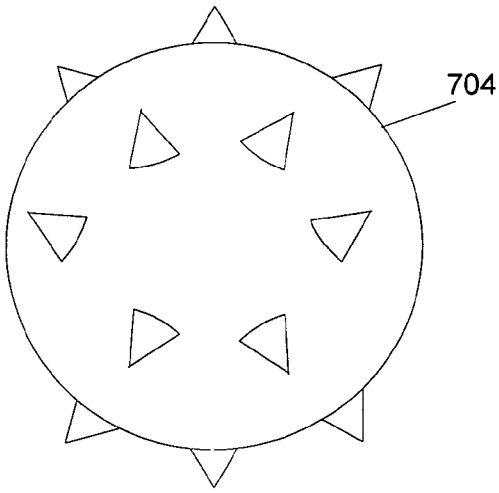
FIG. 7 is a representational diagram illustrating a ball with dispersed contact points.
Figure 8:
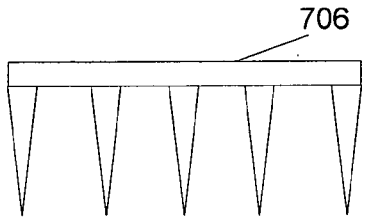
FIG. 8 is a representational diagram illustrating a comb-like walker with dispersed contact points.

Example elements with dispersed raised contact points are shown in FIG. 6A, FIG. 6B, FIG. 7, and FIG. 8. FIG. 6A and FIG. 6B illustrate a pounce wheel 7, which is a wheel with points around its outer rim. Typically pounce wheels 7 have been used to transfer a design onto a surface. A pounce wheel 7 on a handle is rolled over an object and leaves holes in the object's surface, and chalk or another marker is then rubbed over the surface to reveal the holes. For example, pounce wheels 7 are used for tracing regular designs onto wood for wood-burning or carving. FIG. 6B illustrates a view of a pounce wheel 7 at an angle. FIG. 7 illustrates a ball 704 with dispersed points, and FIG. 8 a comb-like walker 706.

In an embodiment, the floating ring 6 shown in FIG. 2 has multiple micro pounce wheels 7, shown in FIG. 6A and FIG. 6B, around the rim. The height of the points maintains a proper distance from the surface for both scanning and inkjet deposition. The pounce wheels 7, shown in FIG. 2, also reduce the amount of outside light entering around the base of the applicator to prevent distorting the accuracy of the scanning. In addition, the points on the pounce wheels 7 limit contact of the applicator head 2 with the cosmetics being deposited, to prevent smudging. Thus, they will typically leave behind minimal deposits of the RMA as they are moved over surfaces.

The pounce wheels 7 should be made of durable non-absorptive and hydrophobic material, for example silicon rubber or Teflon, so that they last and do not absorb the RMA. Their heights should also be low, for example 3⁄16 of an inch (4.8 mm). The use of low heights keeps the system close to the surface so that too much light does not come in underneath the system. The pounce wheels 7 may further be colored black to help absorb light. Their widths should be narrow to further reduce the area that comes into contact with the RMA. Their points should not be very sharp, so that they will not easily puncture surfaces such as skin.

In an embodiment, the pounce wheels 7 may be mounted on thin wires serving as axles.

In an embodiment, twelve pounce wheels may be mounted on each side of the floating ring 6.

In an embodiment, a non-contact, electrostatic wipe (not shown) may be used to blow off the RMA from the pounce wheels 7.

Still other geometrical shapes with dispersed contact points may also be used.

Advantages

Motion means with dispersed contact points are useful for the present invention in several ways. First, the height of the contact points can be used to maintain proper distance from the surface. During scanning, they may be used to maintain a proper distance from the surface to be scanned to ensure effective scanning. During deposition, they may also be used to maintain a proper distance from the surface to be enhanced by application with the RMA and so ensure proper application.

Second, the configuration of the dispersed contact points, explained below, can be used to reduce the amount of outside light entering around the base of the applicator and scanner, to prevent distorting the accuracy of the scanning. In this aspect, the contact points serve a baffle to block outside light.

Third, the dispersion and sharpness of the contact points can be used to limit contact with the RMA on the surface being enhanced, reducing smudging. Other motion means, such as a shroud that simply drags across the surface or wheel with flat rims without raised points, would typically cause greater smudging. Motion means with dispersed contact points are especially useful during multiple-pass enhancement, when the applicator must be moved more than once over a freshly applied RMA that would smudge easily.

Configurations of Motion Means

Figure 9:
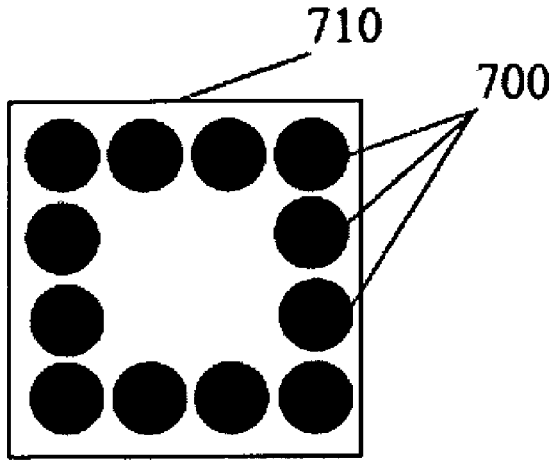
FIG. 9 is a representational diagram illustrating a square configuration of motion means.
Figure 10:
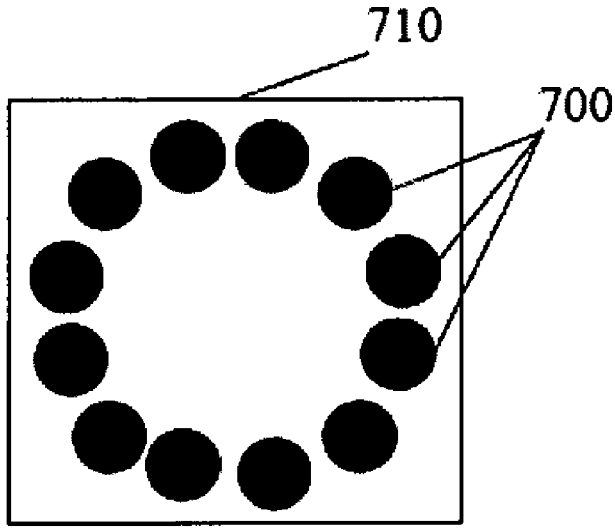
FIG. 10 is a representational diagram illustrating a circular configuration of motion means.

The motion means described above may be mounted in different configurations on an appropriate housing side of elements of the present invention. As shown in FIG. 9, motion means 700 with dispersed contact points may be mounted in a square pattern on a housing side 710. Alternately, these motion means 700 may be mounted in a circular pattern, as shown in FIG. 10, as well as in other useful patterns, for example a rectangle.

The motion means 700 should be made of durable non-absorptive and hydrophobic material, for example silicon rubber or Teflon, so that they last do not absorb the RMA. Thus, they will typically leave behind minimal deposits of the RMA as they are moved over surfaces.

Their heights should also be low, for example 3⁄16 of an inch. The use of low heights keeps elements of the system close to the surface so that too much light doesn't come in underneath the system. Their widths should be narrow to further reduce the area that comes into contact with the RMA Their points should not be very sharp, so that they will not easily puncture surfaces such as skin.

Multiple contact points may be used to achieve the advantages explained above, including baffling light. In an embodiment, twelve pounce wheels or balls may be mounted on a side, as shown in FIG. 9 and FIG. 10. In another embodiment, a hundred comb-like walkers may be mounted in a circle on a side.

The motion means 700 is preferably colored black to help absorb light.

Examples of Embodiments

Figure 11:
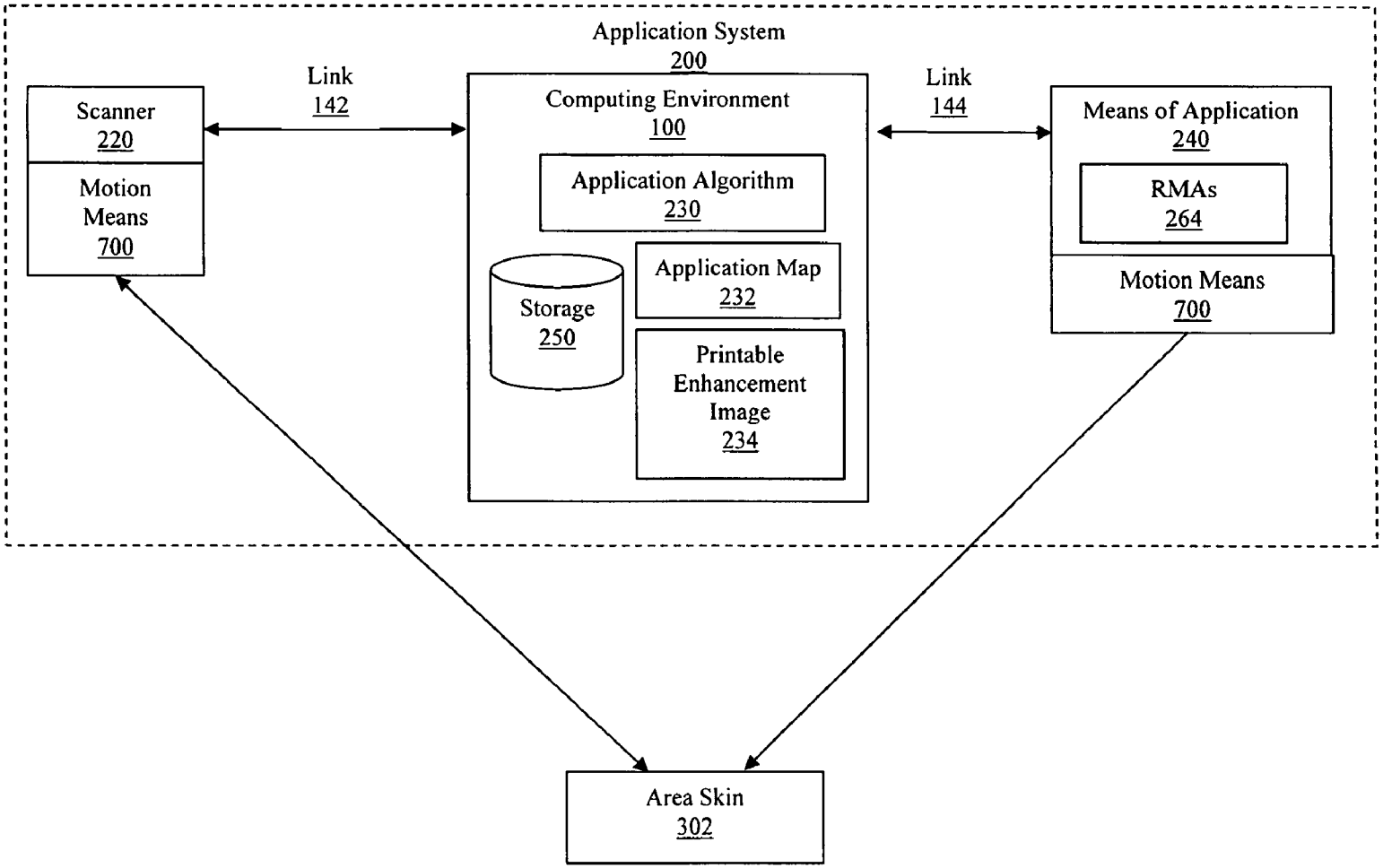
FIG. 11 is a block diagram showing an operating environment in which embodiments of the present invention may be employed for applying RMAs onto skin, using motion means with dispersed contact points.

FIG. 11 shows an operating environment in which embodiments of the present invention may be employed for applying RMAs onto skin, using motion means 700 with dispersed contact points. The motion means 700 may be used on

- the side of the means of application 240 that comes into contact with the surface to be treated, such as an area of skin 302, and
- the side of the scanner 220 that comes into contact with the surface to be treated, such as an area of skin 302.

Figure 12:
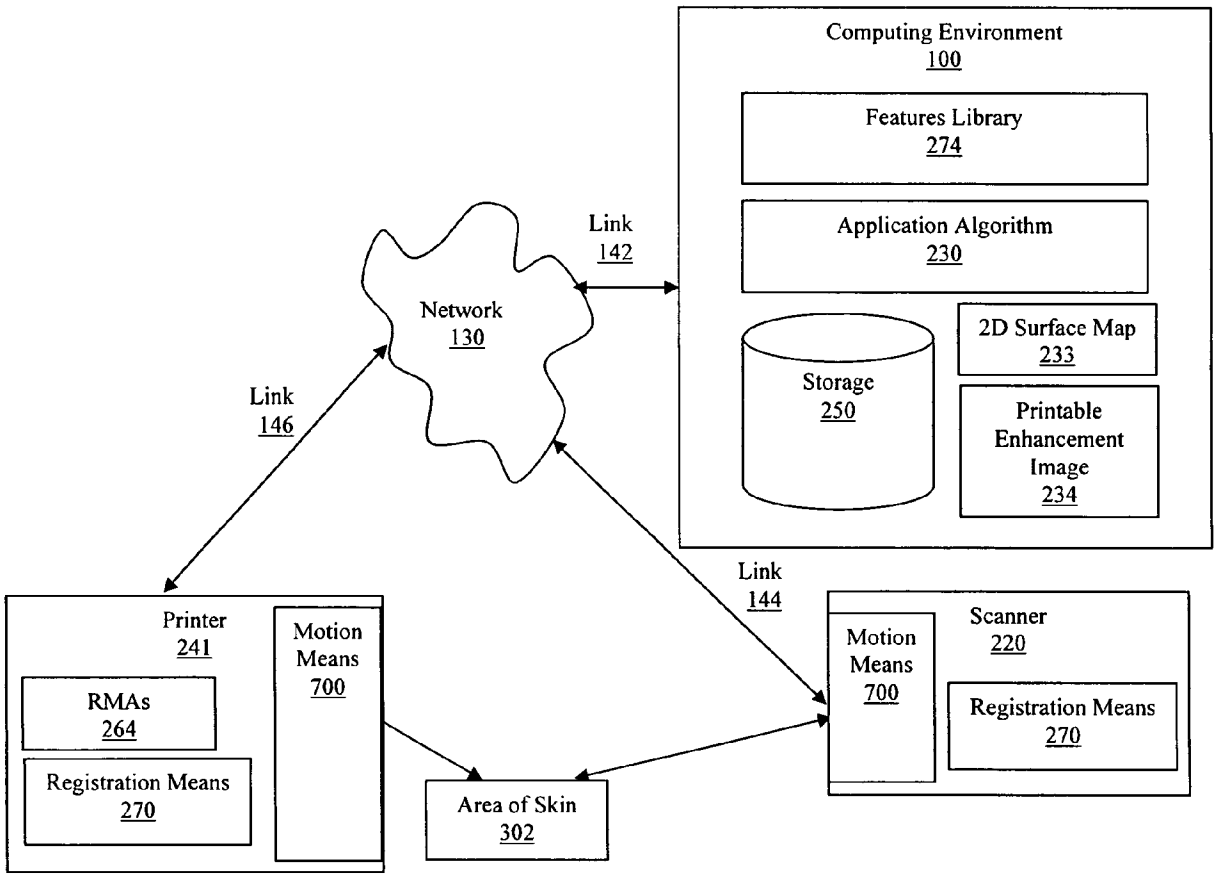
FIG. 12 is a block diagram illustrating an operating environment in which embodiments of the present invention may be employed for applying RMAs onto skin through communications over a network, using motion means with dispersed contact points.

FIG. 12 shows an operating environment in which embodiments of the present invention may be employed for applying RMAs onto skin through communications over a network, using motion means 700 with dispersed contact points. Again, the motion means 700 may be used on

- the side of a printer 241 that comes into contact with the surface to be treated, such as an area of skin 302, and
- the side of the scanner 220 that comes into contact with the surface to be treated, such as an area of skin 302.

Figure 13:
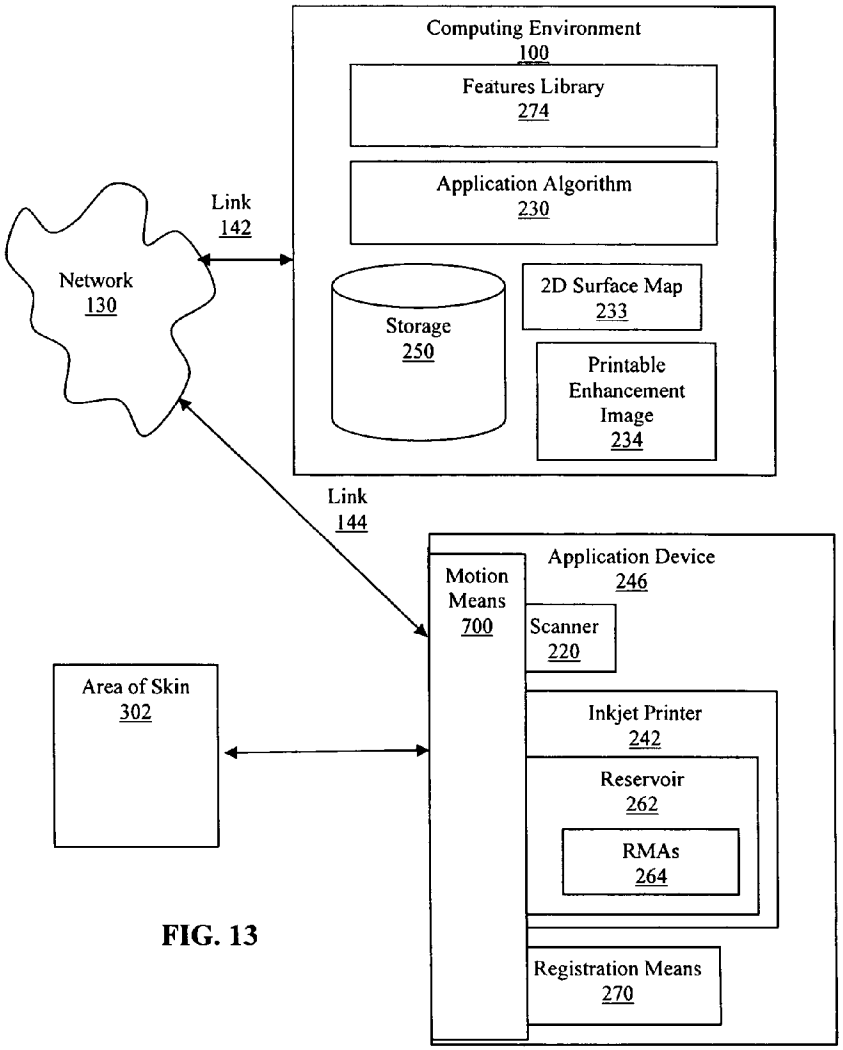
FIG. 13 is a block diagram illustrating an operating environment in which embodiments of the present invention may be employed for applying RMAs onto skin through communications over a network and a portable application device, using motion means with dispersed contact points.

FIG. 13 shows an operating environment in which embodiments of the present invention may be employed for applying RMAs onto skin through communications over a network and a portable application device, using motion means 700 with dispersed contact points. In this embodiment, the motion means 700 may be used on the side of the application device 246 that comes into contact with the surface to be treated, such as an area of skin 302. The application device 246 further comprises both an inkjet printer 242 and a scanner 220.

DETAILED DESCRIPTION OF EMBODIMENT

Differential Lighting

The present invention comprises a method of differential lighting that can be used to determine surface texture from scanned data about an area of skin or other human feature. In an embodiment, this method may be used with a computer-controlled system and method that scans an area of human skin, identifies unattractive attributes, and applies RMA, typically with an inkjet printer, to improve the appearance of that area of skin. U.S. application Ser. No. 11/503,806 by the present applicants describes computer-controlled systems and methods.

The present invention is an innovation comprising a method of differential lighting that, in an embodiment, may be employed using this computer-controlled system and method and applicator head.

In this patent application, the phrase "area of skin" is used to represent any human feature to be enhanced cosmetically.

Light Sources

In this embodiment, a plurality of light sources, such as LEDs, are provided, such that each light source represents a directional orientation with respect to the housing. For example, one directional orientation is a North-South-East-West orientation where one or more lights represents each of those directions. Another directional orientation is a circular alignment of light sources such as three light sources arranged about 120 degrees apart. These three sources may be one or more LED.

Field Lens

A field lens 12 with LED assembly 13 provides telecentric viewing so that size is independent of distance and the view fits around the inkjet head. It fits into case groove 14 and helps protect the electronics behind the lens from water and dirt. In one example as described below, the LEDs are configured on a North/South and East/West alignment so that one or more LEDs representing each of those directions may be cycled on an off.

Using Differential Lighting to Determine Surface Texture

Figure 14:
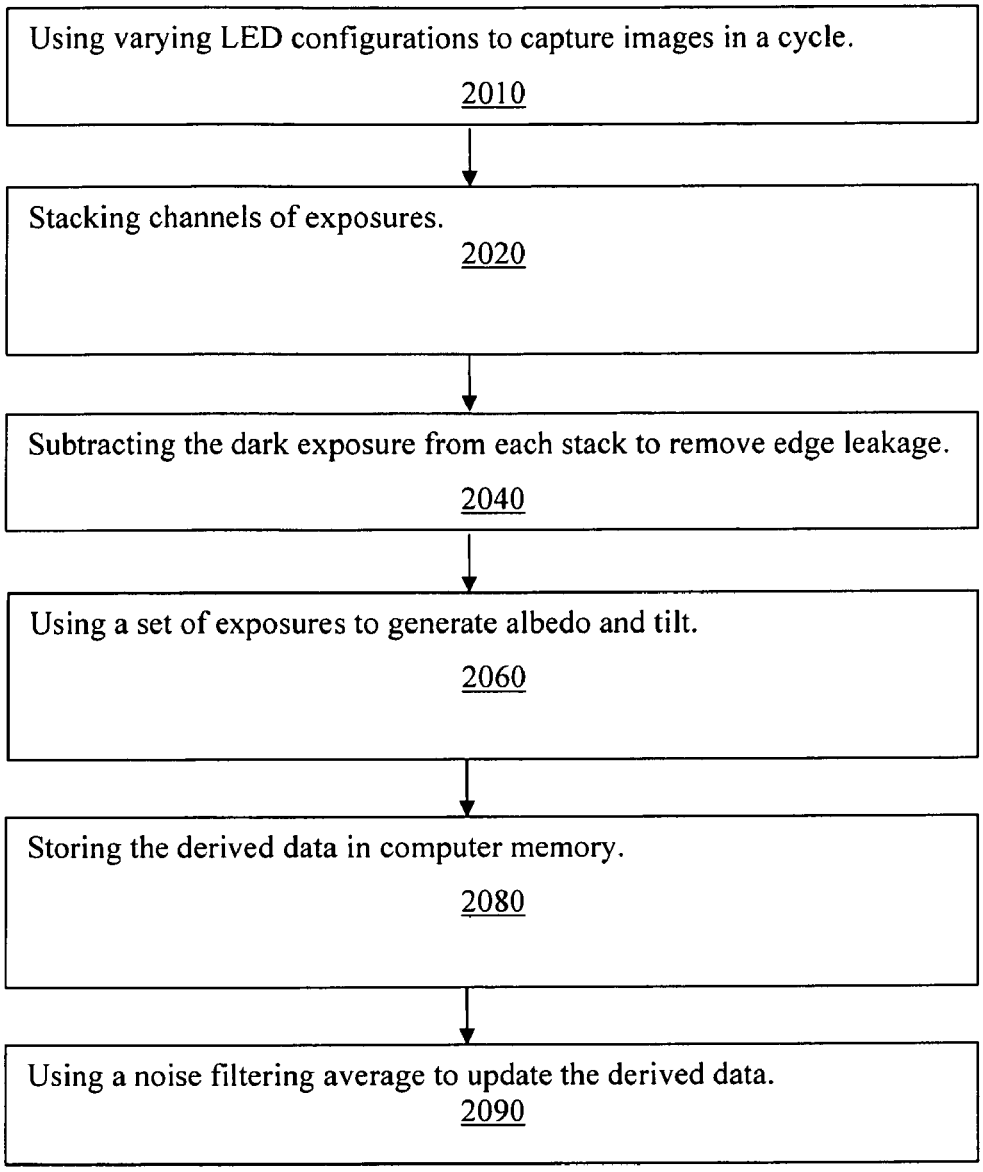
FIG. 14 is a flow chart illustrating the general steps for a process to determine surface texture from scanned data about an area of skin or other human feature.

The general steps of the present invention's method of using differential lighting to determine surface texture from scanned data about an area of skin are illustrated in FIG. 14.

Step 2010 in FIG. 14—Using Varying Lighting Configurations to Capture Images in a Cycle Images are scanned in a cycle by the applicator head 2, shown in FIG. 2, which comprises lighting means and one or more cameras 16. In an embodiment, the lighting means comprise a field lens 12 and LEDs 13.

Figure 15:
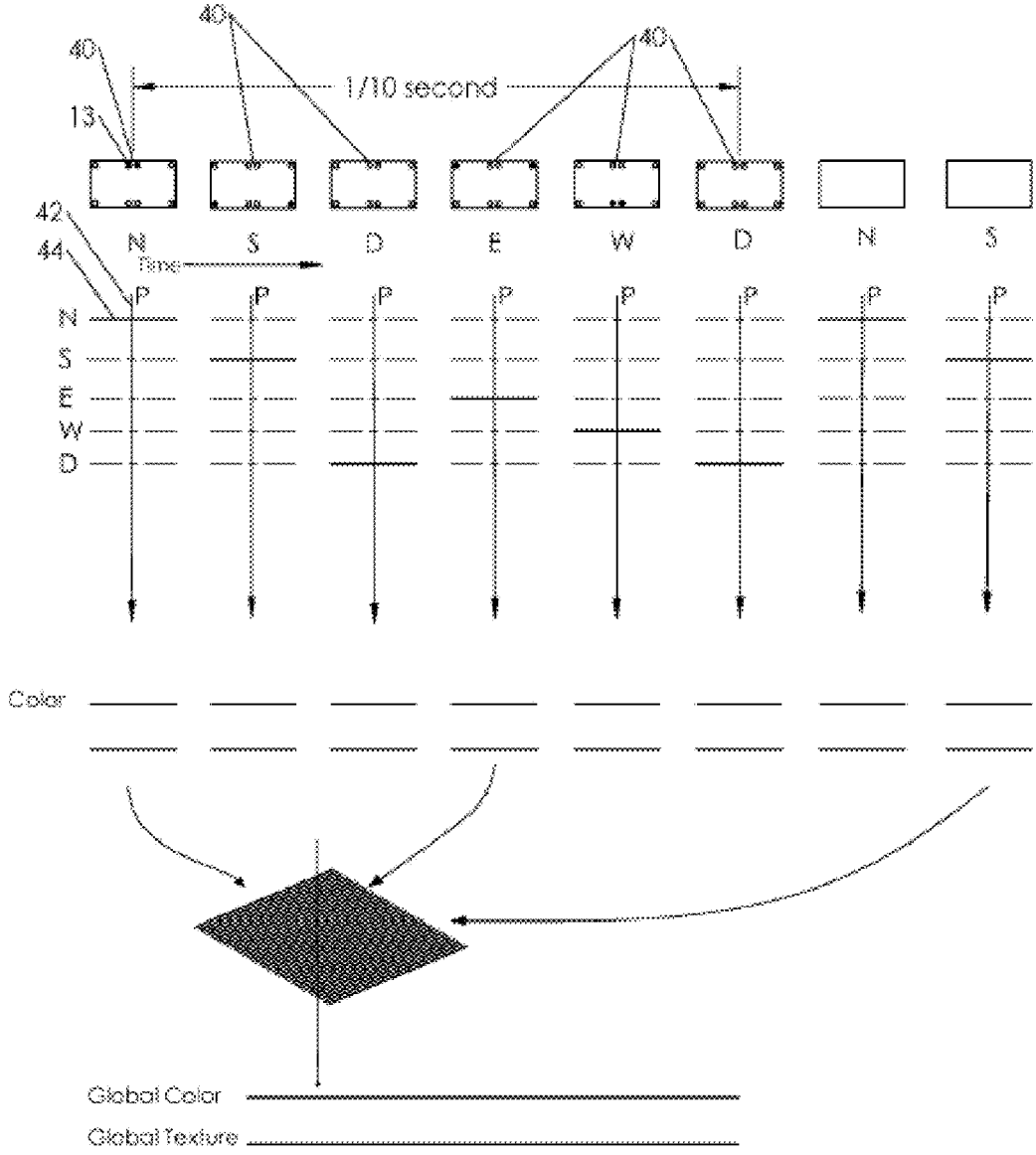
FIG. 15 is a chart illustrating a configuration of exposures for determining textures.

In an embodiment, six images are captured in a cycle of lighting modes. Each image represents an exposure 40, shown in FIG. 15, that is captured in 1/60 second in the US to null out the 120 Hz flicker of ambient fluorescent lighting leaking under the edges of the floating ring 6, shown in FIG. 2, during scanning. As shown in FIG. 15, each exposure 40 in one example lighting cycle represents a different configuration or lighting mode of flashed and unflashed LEDs 13, shown in FIG. 2. As shown in FIG. 15, there is thus an approximate visual positional fix P (Position) every 1/60 second for the exposures 40.

The exposures 40 in a cycle are arbitrarily labeled as follows:

N (North),
S (South),
D (Dark),
E (East),
W (West), and
D (Dark).

There is a hard fix on P, shown in FIG. 15, every 1/20 second, which is fast enough for the software 26, shown in FIG. 2, to track normal movement of the applicator head 2. That is, every third exposure 40, shown in FIG. 15, is D (Dark), an exposure captured with the LEDs 13, shown in FIG. 2, or other lighting means, turned off. This is done so that the software 26, shown in FIG. 2, can identify edge leakage in the D (Dark) exposure 40, shown in FIG. 15, and subtract that edge leakage from calculations.

Step 2020 in FIG. 14—Stacking Channels of Exposures

The exposures 40 are co-synchronized in stacks, where each stack is a grouping of data about a P representing a particular instant of time during the scanning. This data may be obtained from directly captured exposures or from interpolated data.

In the embodiment shown in FIG. 15, five channels of exposures 40, N, S, E, W, and D are stacked in a stack 42 every 1/60 second frame. In other embodiments, the stacking may be calculated at other time periods, for example 1/15 sec.; 1/20 sec.; or 1/30 sec.

One channel 44 in each stack 4 may be directly captured by the camera 16, shown in FIG. 2. The other four channels are then interpolated from data temporally adjacent exposures 40, shown in FIG. 15, based on image movement calculated in software 26, shown in FIG. 2. Such movement may be calculated at video rates by, for example, a hardware motion detection engine in an MPEG encoder, such as the one found in NVIDIA GPUs for mobile devices, or other techniques in CPU software. The use of one or more accelerometers associated with the applicator head 2 may provide additional data showing micro-variations in positioning.

If channel 44, shown in FIG. 15, does not coincide with a real frame captured by the camera 16, shown in FIG. 2, during the camera's 16 capture cycle, channel 44, shown in FIG. 15, may be interpolated from data from one or more temporally adjacent direct exposures 40. That is, data from either a frame captured before channel 44 or after it, or from an average of the two, may be used for interpolation of channel 44.

Interpolations may be derived by simple averaging of data from one or more temporally adjacent frames. A weighted average may also be used, where the weight in the average may be higher for a directly captured frame that is closer in temporal position to the frame that is to be derived.

However, simple averaging may be inaccurate for moving images. Thus, for moving images it may be desirable to "push," or adjust, data about an image in software 26, shown in FIG. 2, according to known position changes and to feature recognition based on a stored model of features, as is done in images for gaming.

Step 2040 in FIG. 14—Subtracting the Dark Exposure from Each Stack to remove Edge Leakage In an embodiment, after the five channels are co-synchronized in a stack 42, shown in FIG. 15, the D (Dark) signal is subtracted from the other four. This gives a precise black level, and eliminates the effect of light leaking around the pounce wheels 7, shown in FIG. 2, so long as the total light is not so bright as to saturate the camera 16 or the ratio so low as to amplify sensor noise excessively.

Step 2060 in FIG. 14—Using a Set of Exposures to Generate Albedo and Tilt In an embodiment, the remaining N, S, E, and W exposures 40, shown in FIG. 15, in a stack 42 are an overspecified set of three exposures 40 each, which are used to generate three numbers, namely the albedo (color), the north-south tilt, and the east-west tilt of each area of skin. The overspecification allows some options to detect and remove specular reflections when the fourth dimension is in disagreement. In one example, the color is actually three numbers for R, G, and B, while the captured image is reduced to monochrome using the lowest noise combination before calculating tilt.

The tilt is a complex equation derived from the differential brightness as seen when illuminated by each LED 13, shown in FIG. 2, as a function of the four LED configurations. Because the angle struck by each LED 13 varies across the field, the equation changes for each pixel. The practical approach to refine the equation is to first reduce the image to a N/S and E/W differential, and then calibrate gains in a matrix empirically by passing the applicator head 2 over a dimpled surface with known dimple depth.

Step 2080 in FIG. 14—Storing the Derived Data in Computer Memory

Again based on the known visual position "P" of each exposure 40, shown in FIG. 15, the derived data is stored in the computer memory of computer 24, shown in FIG. 2.

Step 2090 in FIG. 14—Using a Noise Filtering Average

The stored data is updated using a noise filtering average.

Other Applications

The method explained above may be adapted for extrapolating the position of the applicator for actual application of the RMA, for example for firing the inkjet head 8 shown in FIG. 2.

In practice, the view from the leading part of the applicator head 2 would confirm and refine position of the applicator head 2 prior to deposition. The "P" value, shown in FIG. 15, would be extrapolated to determine the exact moment to fire the inkjet head 8, shown in FIG. 2, because the skin is not visible when directly under the inkjet head 8. The differential of P, shown in FIG. 15, indicating velocity, would be used to determine how rapidly to fire the inkjet head 8, shown in FIG. 2. For example, the inkjet head 8 would deposit more ink to attain an aim density if the applicator head 2 were moving faster, or deposition would stop if the applicator head 2 were held motionless at the end of a stroke. The trailing part of the applicator head 2 would then be used to update the data about color and texture with the effects of the immediately preceding deposition.

In an embodiment, the applicator head 2 is bidirectional, and can be passed back and forth over the skin with continuous deposition. The sensing of the leading and trailing part of the applicator head 2 would alternate according to software's 26 determination of position and direction of movement.

Reducing Reflections and Glare

In an embodiment, the molded plastic case 4, shown in FIG. 2, may be colored black to reduce retro reflections and reverse reflections off the opposite wall relative to a particular LED configuration.

In an embodiment, several LEDs 13, like those shown in FIG. 2, may be stacked in a group, or other diffusion techniques may be used to reduce specular glare effects. In addition, polarization may be highly beneficial to reduce specular glare effects, although this may complicate assembly and require several fold more power and light from the LEDs 13.

Other Hardware and Software

It will also be apparent to those skilled in the art that different embodiments of the present invention may employ a wide range of possible hardware and of software techniques. For example the communication between a Web service provider and client business computers could take place through any number of links, including wired, wireless, infrared, or radio ones, and through other communication networks beside those cited, including any not yet in existence.

Also, the term computer is used here in its broadest sense to include personal computers, laptops, telephones with computer capabilities, personal data assistants (PDAs) and servers, and it should be recognized that it could include multiple servers, with storage and software functions divided among the servers. A wide array of operating systems, compatible e-mail services, Web browsers and other communications systems can be used to transmit messages among client applications and Web services.

What is claimed is:

1. A handheld reflectance modifying agent applicator, comprising a reflectance modifying agent applicator head comprising
- a case,
- an inkjet printer head,
- a camera,
- a cosmetic reservoir,
- a plurality of light sources, the applicator head in communication with a computing environment that processes a plurality of images of an area of skin captured using the camera, each image corresponding to a directional orientation of a light source of the plurality of light sources relative to the case, that calculates cosmetic enhancements to the area of skin and that determines a position of the applicator head relative to a skinmark in the area of skin based on the plurality of images to apply a reflectance modifying agent to the skinmark based on the calculated cosmetic enhancements, and a light source controller, such that the light source controller provides a lighting cycle comprising a plurality of lighting modes, the lighting modes comprising:
- a first mode where only light sources representing a first directional orientation are turned on,
- a second mode where only light sources representing a second directional orientation are turned on, and a third mode where only light sources representing a third directional orientation are turned on.

2. The handheld reflectance modifying agent applicator of claim 1, further comprising:

a power and data cable from the applicator head to a computer of the computing environment; and cosmetic enhancement software that is processed by the computer.

3. The handheld reflectance modifying agent applicator of claim 1, further comprising a floating ring having a plurality of raised contact points that maintain a distance between the applicator head and the area of skin.

4. The handheld reflectance modifying agent applicator of claim 3, wherein the plurality of raised contact points comprise a plurality of pounce wheels.

5. The handheld reflectance modifying agent applicator of claim 4, wherein the plurality of pounce wheels have a plurality of points having a height of about 4 to 5 millimeters.

6. The handheld reflectance modifying agent applicator of claim 3, wherein the plurality of raised contact points comprise a comb-like walker.

7. The handheld reflectance modifying agent applicator of claim 1, further comprising a field lens assembly comprising:

a telecentric field lens; and an LED assembly.

8. The handheld reflectance modifying agent applicator of claim 1, wherein the lighting modes further comprise a dark mode where no light sources are turned on.

9. The handheld reflectance modifying agent applicator of claim 3, wherein the computing environment processes the plurality of images, calculates the cosmetic enhancements and determines the position of the applicator head during an application session, the application session beginning when the applicator head touches the area of skin and ending then the applicator head is retracted from the area of skin.

10. A method of applying a reflectance modifying agent, the method comprising providing a handheld reflectance modifying agent applicator comprising a reflectance modifying agent applicator head, comprising:

a case, an inkjet printer head, a camera, a cosmetic reservoir, and a plurality of light sources;

capturing images of portions of an area of skin using the camera as the applicator head is moved over the area of skin, each image corresponding to a directional orientation of a light source of the plurality of light sources relative to the case;

calculating cosmetic enhancements to the area of skin based on the plurality of images;

determining a position of the applicator head relative to a skinmark in the area of skin based on the plurality of images;

applying a reflectance modifying agent to the skinmark based on the calculated cosmetic enhancements; and cycling lighting of the plurality of light sources using a light source controller, the light source controller providing a lighting cycle comprising a plurality of lighting modes, the lighting modes comprising:

a first mode where only light sources representing a first directional orientation are turned on, a second mode where only light sources representing a second directional orientation are turned on, and a third mode where only light sources representing a third directional orientation are turned on.

11. The method of claim 10, wherein the applicator head further comprises a floating ring having a plurality of raised contact points that maintain a distance between the applicator head and the area of skin.

12. The method of claim 11, wherein the floating ring comprises a plurality of pounce wheels.

13. The method of claim 11, wherein the floating ring comprises a comb-like walker.

14. The method of claim 10, wherein the lighting modes further comprise a dark mode where no light sources are turned on.

15. The method of claim 10, wherein capturing images comprises:

capturing at least one image for each lighting mode for each lighting cycle;

analyzing the plurality of images to compensate for image movement and to compensate for ambient lighting;

capturing images of portions of the area of skin while providing the lighting cycle;

adjusting the images to account for applicator movement between images;

using dark exposures to compensate for ambient light; and determining albedo and tilt.

* * * * *

UNITED STATES PATENT AND TRADEMARK OFFICE

CERTIFICATE OF CORRECTION

PATENT NO. : 7,890,152 B2
APPLICATION NO. : 12/028835
DATED : February 15, 2011
INVENTOR(S) : Albert D. Edgar et al.

It is certified that error appears in the above-identified patent and that said Letters Patent is hereby corrected as shown below:

IN THE CLAIMS:

Column 13, line 30, in claim 9, delete "3" and insert -- 1 --.

Signed and Sealed this
Fifth Day of April, 2011

David J. Kappos

David J. Kappos
*Director of the United States Patent and Trademark Office*